US009757731B2

(12) United States Patent
Didion

(10) Patent No.: US 9,757,731 B2
(45) Date of Patent: Sep. 12, 2017

(54) INTERLOCKING LINER SEGMENTS FOR A TUMBLING UNIT

(71) Applicant: Michael S. Didion, St. Peters, MO (US)

(72) Inventor: Michael S. Didion, St. Peters, MO (US)

(73) Assignee: Didion Manufacturing Company, St. Peters, MO (US)

( * ) Notice: Subject to any disclaimer, the term of this patent is extended or adjusted under 35 U.S.C. 154(b) by 519 days.

(21) Appl. No.: 14/121,185

(22) Filed: Aug. 11, 2014

(65) Prior Publication Data

US 2015/0069159 A1 Mar. 12, 2015

Related U.S. Application Data

(60) Provisional application No. 61/960,137, filed on Sep. 11, 2013.

(51) Int. Cl.
*B02C 17/22* (2006.01)
*B02C 17/18* (2006.01)

(52) U.S. Cl.
CPC ..... *B02C 17/22* (2013.01); *B02C 17/1825* (2013.01)

(58) Field of Classification Search
CPC ..... B02C 17/22; B02C 17/1825
USPC ..... 241/182–183
See application file for complete search history.

(56) References Cited

U.S. PATENT DOCUMENTS

| | | | | | |
|---|---|---|---|---|---|
| 2,268,661 | A * | 1/1942 | Kennedy | B02C 17/22 | 241/183 |
| 2,885,156 | A * | 5/1959 | Wolfe | B02C 17/22 | 241/182 |
| 2,967,671 | A * | 1/1961 | Falla | B02C 17/22 | 241/176 |
| 3,295,772 | A * | 1/1967 | Cunningham | B02C 17/18 | 241/182 |
| 3,595,267 | A * | 7/1971 | Anderson | G01F 23/247 | 137/558 |
| 4,235,386 | A | 11/1980 | Larsen | | |
| 5,638,890 | A * | 6/1997 | Didion | B22D 31/007 | 164/131 |
| 5,752,665 | A * | 5/1998 | Wason | B02C 17/225 | 241/183 |
| 5,806,774 | A | 9/1998 | Vis | | |
| 5,950,944 | A | 9/1999 | Larsen | | |
| 6,206,310 | B1 * | 3/2001 | Schneider | B02C 17/22 | 241/183 |
| 8,622,330 | B2 * | 1/2014 | Mepham | B02C 17/225 | 241/182 |
| 2002/0023729 | A1 | 2/2002 | Didion et al. | | |

(Continued)

FOREIGN PATENT DOCUMENTS

| | | | |
|---|---|---|---|
| RU | 2284861 | C1 | 10/2006 |
| WO | WO 2012/171825 | A2 | 12/2012 |

*Primary Examiner* — Faye Francis
(74) *Attorney, Agent, or Firm* — Paul M Denk

(57) ABSTRACT

An interlocking liner segment for a tumbling unit is disclosed which comprises a body having an inner surface having a first end and a second end, an outer surface, a first side edge, a second side edge opposite the first side edge, a front edge, and a back edge, a first lifter portion at the first end having a first aperture; a second lifter portion at the second end having a second aperture; and a rifling portion on the inner surface intermediate the first lifter portion and the second lifter portion.

7 Claims, 4 Drawing Sheets

(56) References Cited

U.S. PATENT DOCUMENTS

2014/0150524 A1* 6/2014 Magne ..... B02C 17/1805
73/1.82
2015/0283549 A1* 10/2015 Malmqvist ..... B02C 2/005
241/207

* cited by examiner

INTERLOCKING LINER SEGMENTS FOR A TUMBLING UNIT

CROSS REFERENCE TO RELATED APPLICATION

This non-provisional patent application claims priority to the provisional patent application having Ser. No. 61/960,137, filed on Sep. 11, 2013.

FIELD OF THE DISCLOSURE

This disclosure generally relates to an interlocking liner for a tumbling unit, and more particularly, to a connecting means for liner segments for an interlocking liner for a tumbling unit, casting shakeout, and sand reclaimer that do not necessarily require bolts or welds to secure the liner within the tumbling unit.

BACKGROUND

In the formation of a tumbling unit or mill, such as a casting shake-out unit, rotary separator, media drum, material drier, lump crusher reclaimer, blending drum, sand screen, or the like, it is desirable to form an inner surface of the tumbling unit from segments. When individual segments wear out, the worn segment can be replaced easily and rapidly without the need to incur a significant amount of downtime or expense. The inner liners usually are also bolted to a drum shell or cylinder by use of numerous bolts. The bolts have a tendency to wear down and the life of the liner may be determined by the life of the bolts. Even if the bolts are recessed, once the liner or deck wears down to the recess, the bolt heads are worn away and a new liner will be required. Although new bolts may be used, this requires constant re-bolting which can be time consuming. Also, some tumbling units, such as a casting shake-out unit, are operated continuously and the wear on the components causes the components or segments to gradually loosen. This requires a re-tightening of the entire formed inner surface. This re-tightening operation requires that the operation of the tumbling unit incur a significant amount of down time. In view of this, it would be desirable for the tumbling unit to operate for a longer period before the segments begin to wear, loosen, and separate. Also, it would be advantageous to have an interlocking liner that does not require bolts or other exposed fastening devices to secure or retain the interlocking liner within a tumbling unit.

The present disclosure is designed to obviate and overcome many of the disadvantages and shortcomings experienced with prior interlocking liners. Moreover, the present disclosure is related to an interlocking liner that is designed and constructed to eliminate the use of bolts to provide a longer life for an interlocking liner used in a tumbling unit.

SUMMARY OF THE DISCLOSURE

The present disclosure is an interlocking liner for a tumbling unit which comprises a body segment having an inner surface having a first end and a second end, an outer surface, a first side edge, a second side edge opposite the first side edge, a front edge, and a back edge, a first lifter portion at the first end having at least a first aperture; a second lifter portion at the second end having at least a second aperture; and a rifling portion on the inner surface intermediate the first lifter portion and the second lifter portion.

The present disclosure is also related to an interlocking liner formed of liner segments for a tumbling unit which comprises an arcuate body having an inner surface having a first end and a second end, an outer surface, a first side edge, a second side edge opposite the first side edge, a front edge, and a back edge, a first lifter portion at the first end having a first pair of apertures, a second lifter portion at the second end having a second pair of apertures, and a rifling portion on the inner surface intermediate the first lifter portion and the second lifter portion.

In the preferred embodiment, this tumbling unit is designed to break grinding balls apart from each other after they have been cast, as for example, at a foundry. Such grinding balls may be linked together, from the casting process, by means of a thin link, which must be broken, and removed, to prepare the grinding balls for further usage and application. This specific tumbling unit, with its liner segments, incorporates both lifting capabilities, and the rifling to urge movement of the cast balls along the length of the drum, with the liner segments integrating these components, and includes means for facilitating the linking of the liner segments together, in preparation for usage.

In light of the foregoing comments, it will be recognized that the present disclosure provides an interlocking liner for a tumbling unit that is simple to operate, is longer wearing, and does not require to be tightened.

The present disclosure provides an interlocking liner for a tumbling unit that can be easily employed with highly reliable results to increase the life of a tumbling unit The present disclosure also provides an interlocking liner for a tumbling unit that may be quickly and easily assembled within the tumbling unit.

The present disclosure further provides an interlocking liner for a tumbling unit that is compatible with, and can be readily incorporated into, existing tumbling units without the need to reconfigure or modify the existing tumbling unit.

The present disclosure provides an interlocking liner for a tumbling unit which is capable of fitting tightly within the tumbling unit.

The present disclosure also provides an interlocking liner for a tumbling unit which can be operated for a longer period of time before the liner needs to be replaced or re-tightened.

The present disclosure provides an interlocking liner for a tumbling unit which does not require bolts, and does not normally require the liner to be bolted to the tumbling unit.

These and other advantages of the present disclosure will become apparent to those skilled in the art after considering the following detailed specification in conjunction with the accompanying drawings.

DETAILED DESCRIPTION OF PREFERRED EMBODIMENTS

Figure 1:
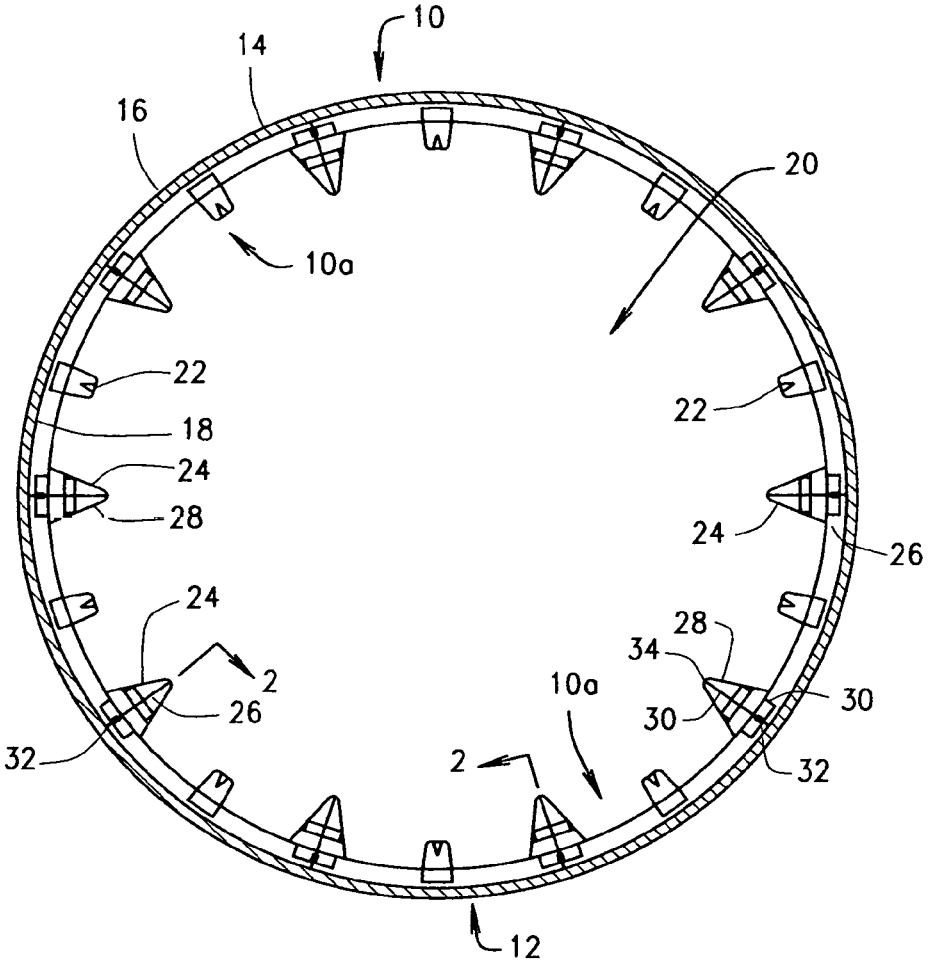
FIG. 1 is an end view of a tumbling unit having multiple interlocking liners constructed according to the present disclosure disposed in the tumbling unit with portions of the interlocking liners shown in phantom.

Referring now to the drawings, wherein like numbers refer to like items, number 10 identifies a preferred embodiment of an interlocking liner for a tumbling unit constructed according to the present disclosure. With reference now to FIG. 1, the interlocking liner 10 is shown installed within a tumbling unit 12. The tumbling unit 12 has a cylinder 14 having an exterior surface 16 and an interior surface 18. The interior surface 18 has a plurality of the interlocking liners or segments 10*a* fitted together and resting thereon to form an interior cylinder 20. Within this particular view of the tumbling unit 12, there are approximately ten individual interlocking liner segments 10, more or less, that are used to form a portion of the interior cylinder 20. To form a complete interior cylinder 20, numerous alternating, offset, or staggered rows of the interlocking liner segments 10 are required to cover the interior surface 18 of the tumbling unit 12. As will be described in detail herein, the liners 10 positively lock together so that the liner segments 10 will not fall out of the interior cylinder 20 as the liners 10 wear during operation and use of the unit 12. This advantageously increases the time the unit 12 may be continuously operated before the unit 12 has to be shut down. During operation of the unit 12, the interior cylinder 20 may receive castings (not shown) that need to be separated by turning of the tumbling unit 12. For example, castings are inserted into the interior cylinder 20 of the tumbling unit 12 and may be separated by turning the unit 12 at some controlled speed. During separation, the castings, such as grinding balls, will strike and impact the interlocking liners 10 obviously causing wear to the interlocking liner segments 10. However, since there are no bolts or exposed bolts within the interior cylinder 20, the unit 12 will not have to be shut down to tighten anything. This provides for longer operation of the unit 12.

While the improvements of the liner segments as described in this application are for use in the preferred embodiment within a tumbling unit, such as for separating castings, as explained, it is just as likely that the structure of this unit, with its formed liner segments, could also be used within other types of machines, as previously explained, such as in a casting shakeout, sand or slag reclaimer, and other related equipment as previously summarized.

The interlocking liner 10 comprises a rifling member 22, a first lifter member 24 at a first end 26, and a second lifter member 28 at a second end 30. Together these half lifters form a complete and full lifter for the intermated liner segments. The rifling member 22 is used to move castings through the tumbling unit 12. The lifter members 24 and 28 are used to tumble the castings through the tumbling unit 12. The first lifter member 24 is adapted to mate with a second lifter member 28 of an adjacent interlocking liner 10. To form the complete lifter, a locking pin 32 is provided to force each of the interlocking liner segments 10 apart to tighten the interlocking liners 10 against the interior surface 18 of the cylinder 14.

Figure 2:
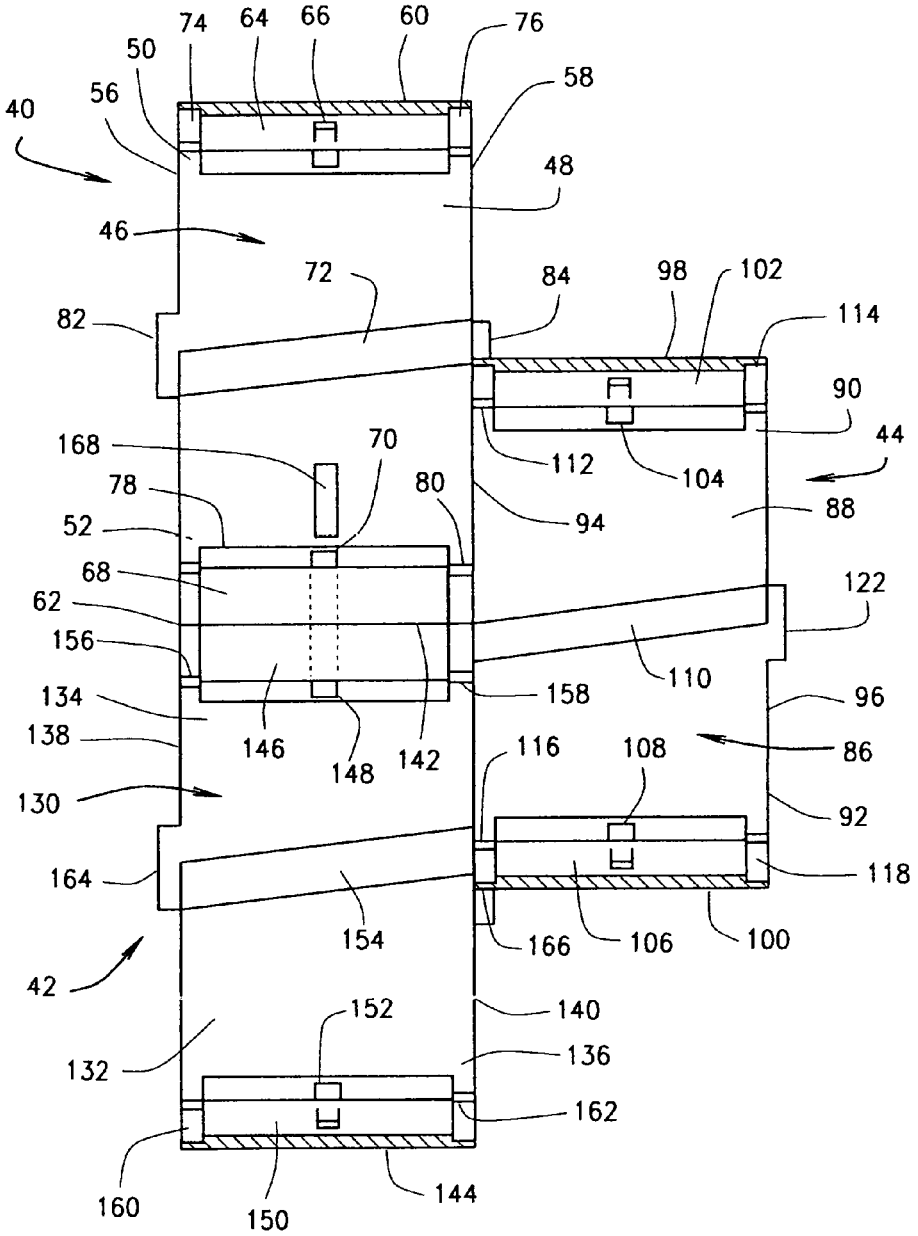
FIG. 2 is an inner view of a series of interlocking liner segments constructed according to the present disclosure taken along the plane of line 2-2 in FIG. 1 with portions of the interlocking liners shown in phantom.

Referring now to FIG. 2, a perspective view of three interlocking liner segments 40, 42, and 44 being mated together are shown. The liner 40 comprises a body 46 having an inner surface 48 and a first end 50 and a second end 52, an outer or back surface 54 (FIG. 3), a first side edge 56, a second side edge 58 opposite the first side edge 56, a front edge 60, and an opposite back edge 62. The liner 40 further comprises a first lifter portion 64 at the first end 50 having at least a first aperture 66, a second lifter portion 68 at the second end 52 having at least a second aperture 70, and a rifling portion 72 on the inner surface 48 intermediate the first lifter portion 64 and the second lifter portion 68. The liner 40 also comprises a first pocket 74 formed in the first side edge 56 at the first end 50 and a second pocket 76 formed in the second side edge 58 at the first end 50. On the second end 52 there is formed a third pocket 78 in the first side edge 56 and a fourth pocket 80 in the second side edge 58. A first side flange 82 extends out from the first side edge 56 intermediate the first end 50 and the second end 52. A second side flange 84 extends out from the second side edge 58 intermediate the first end 50 and the second end 52. These pockets and side flanges interengage together to secure the liner segments together.

The liner 44 comprises a body 86 having an inner surface 88 having a first end 90 and a second end 92, an outer or back surface (not shown), a first side edge 94, a second side edge 96 opposite the first side edge 94, a front edge, 98 and a back edge 100. The liner 44 further comprises a first lifter portion 102 at the first end 88 having a first aperture 104, a second lifter portion 106 at the second end 90 having a second aperture 108, and a rifling portion 110 on the inner surface 88 intermediate the first lifter portion 102 and the second lifter portion 106. The liner 44 also comprises a first pocket 112 formed in the first side edge 94 at the first end 90 and a second pocket 114 formed in the second side edge 96 at the first end 90. On the second end 92 there is formed a third pocket 116 in the first side edge 94 and a fourth pocket 118 in the second side edge 96. A first side flange 120 extends out from the first side edge 94 intermediate the first end 90 and the second end 92. A second side flange 122 extends out from the second side edge 96 intermediate the first end 90 and the second end 92. The first pocket 112 is adapted to receive a portion of the second side flange 84 of the adjacent liner 40. In this manner, the liners 40, 42, and 44 may be interlocked to each other to hold or secure the liners 40, 42, and 44 in place and to form the interior cylinder 20. As can be appreciated, this will orientate the liners 40 and 44 in an overlapping configuration. In the completed interior cylinder 20, the rifling portions 72 and 110 assist in moving longitudinally castings through the unit 12 when the unit 12 is being rotated. The rifling portions 72 and 110 are formed on the liners 40 and 44 so that the rifling portion 72 of the liner 40 is staggered or offset from the rifling portion 110 of the liner 44. Thus, the rifling portions 72 and 110 do not normally form continuous rifling along the interior cylinder 20. Although this is not to say that such rifling could be continuous in a modified design.

The liner 42, in FIG. 2, is depicted comprising a body 130 having an inner surface 132 having a first end 134 and a second end 136, an outer or back surface (not shown), a first side edge 138, a second side edge 140 opposite the first side edge 138, a front edge, 142 and a back edge 144. The liner 42 further comprises a first lifter portion 146 at the first end 134 having a first aperture 148, a second lifter portion 150 at the second end 136 having a second aperture 152, and a rifling portion 154 on the inner surface 132 intermediate the first lifter portion 146 and the second lifter portion 150. The liner 42 also comprises a first pocket 156 formed in the first side edge 138 at the first end 134 and a second pocket 158 formed in the second side edge 140 at the first end 134. On the second end 136 there is formed a third pocket 160 in the first side edge 138 and a fourth pocket 162 in the second side edge 140. A first side flange 164 extends out from the first side edge 138 intermediate the first end 134 and the second end 136. A second side flange 166 extends out from the second side edge 140 intermediate the first end 134 and the second end 136. The second pocket 158 is adapted to receive a portion of the first side flange 120 of the adjacent liner 44. A locking pin 168 is inserted into the second aperture 70 of the second lifter portion 68 of interlocking liner 40 and in the first aperture 148 of the first lifter portion 146 of the interlocking liner 44 to lock or connect the liners 40 and 44 together. This pin 168 can be forcefully hammered in place into the two adjacent lifter segments to further lock a pair of liner segments together. Use of the locking pin 168 ensures that no bolts will have to be used to connect the liners 40 and 44 to the cylinder 14. As can be appreciated, other locking pins 168 may be used in the other apertures 66, 104, 108, and 152 to lock or connect other liners together to form the interior cylinder 20. Even more than one pin can be used to hold the lifters together.

Figure 3:
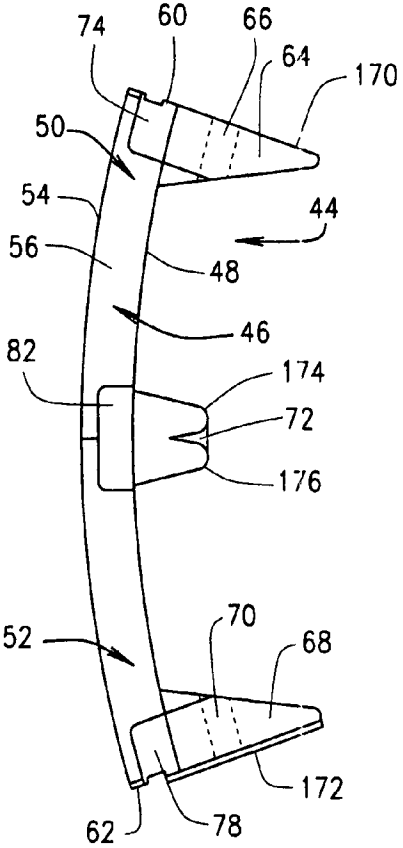
FIG. 3 is a side view of one interlocking liner segment constructed according to the present disclosure with portions of the interlocking liner shown in phantom.

FIG. 3 shows a side view of the interlocking liner segment 40. The liner 40 has the body 46 having the inner surface 48 having the first end 50 and the second end 52, the outer surface 54, the first side edge 56, the second side edge 58 (FIG. 2) opposite the first side edge 56, the front edge 60, and the back edge 62. The body 46 has an arcuate shape that allows the liner 40 to be placed contiguously against the interior surface 18 of the cylinder 14 of the tumbling unit 12. The liner 40 further comprises the first lifter portion 64 at the first end 50 having the first aperture 66 and the second lifter portion 68 at the second end 52 having the second aperture 70. The lifter portions 64 and 68 are generally triangular in shape. The first lifter portion 64 has a back surface 170 that is adapted to mate with another back surface of an adjacent liner when the liners are abutted next to each other. The second lifter portion 68 also has a back surface 172. The rifling portion 72 is positioned on the inner surface 48 intermediate the first lifter portion 64 and the second lifter portion 68. The rifling portion 72 may consist of a pair of rib portions 174 and 176. The liner 40 also comprises the first pocket 74 formed in the first side edge 56 at the first end 50 and the third pocket 78 formed in the first side edge 56. The first side flange 82 is shown extending out from the first side edge 56 intermediate the first end 50 and the second end 52. As has been indicated, the liner 40 is used in conjunction with other liners, such as the liners 42 and 44, to form the interior cylinder 20.

Figure 4:
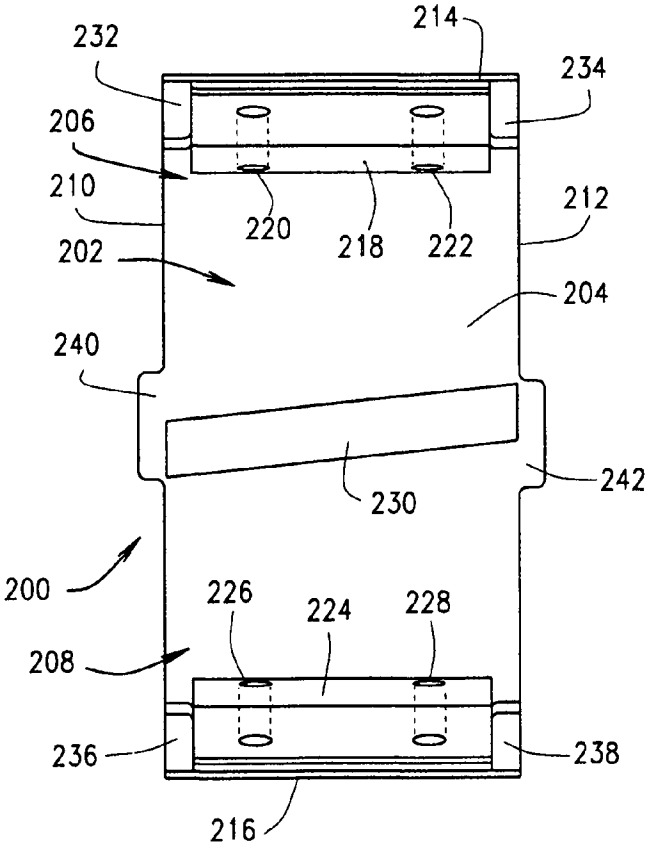
FIG. 4 is an inner view of the embodiment of an interlocking liner segment constructed according to the present disclosure with portions of the interlocking liner shown in phantom, as shown in FIG. 3.

With reference now to FIG. 4, another embodiment of an interlocking liner 200 as constructed according to the present disclosure is shown. The liner 200 comprises a body 202 having an inner surface 204 having a first end 206 and a second end 208, an outer or back surface (not shown), a first side edge 210, a second side edge 212 opposite the first side edge 210, a front edge 214, and a back edge 216. The liner 200 further comprises a first lifter portion 218 at the first end 206 having a first aperture 220 and a second aperture 222. A second lifter portion 224 is provided at the second end 208 having a first aperture 226 and a second aperture 228 formed in the second lifter portion 224. A rifling portion 230 is provided on the inner surface 204 intermediate the first lifter portion 218 and the second lifter portion 224. The liner 200 also comprises a first pocket 232 formed in the first side edge 210 and the front edge 214 at the first end 206 and a second pocket 234 formed in the second side edge 212 and the front edge 214 at the first end 206. On the second end 208 there is formed a third pocket 236 in the first side edge 210 and the back edge 216 and a fourth pocket 238 is formed in the second side edge 212 and the back edge 216. A first side flange 240 extends out from the first side edge 210 intermediate the first end 206 and the second end 208. A second side flange 242 extends out from the second side edge 212 intermediate the first end 206 and the second end 208. The interlocking liner 200 will require two locking pins (not shown) to be inserted into the apertures 220 and 222 to lock or connect the liner 200 to an adjacent liner.

Figure 5:
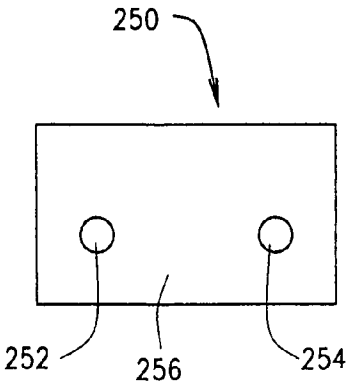
FIG. 5 is a front view of a shim.

FIG. 5 shows a perspective view of a liner shim 250 that may be used to eliminate any gap caused by use of the locking pins 32. The liner shim 250 has a first aperture 252 and a second aperture 254. The apertures 252 and 254 are aligned with the apertures 220 and 222 of the liner 200 to allow one or more locking pins to pass therethrough. Each locking pin will hold the liner shim 250 in place between two adjacent liners 200. The shim liner 250 has a generally rectangular shape and may be the same size as the lifter portion 218 or smaller than the lifter portion 218. The shim 250 may be constructed having various thicknesses to be able to use one or more shims 250 to close any sized gap between two adjacent liners 200. It is also contemplated that the shim 250 may only have one aperture so that the shim can be used with the liners 10, 40, 42, or 44.

As can be appreciated, the liners 10, 40, 42, 44, and 200 are each a segment that may be used to form an inner lining or an inner cylinder of a tumbling unit. The liners 10, 40, 42, 44, and 200 are shaped and configured to fit or mesh together with adjacent or neighboring liners to form the inner lining of the tumbling unit. In this manner, the liners 10, 40, 42, 44, and 200 are interconnected in such a manner that each segment or liner will not fall out of the inner lining. The locking pin 168 also ensures that the liners are connected to each other to further hold the liners in place within the tumbling unit.

To assemble the interior cylinder 20 from the liners 40, 42, and 44, the liners 40, 42, and 44 are assembled with the flanges 82, 84, 120, 122, 164, 166 being inserted into various adjacent pockets 74, 76, 78, 80, 112, 114, 116, 118, 156, 158, 160, and 162 in an overlapping relationship, as shown in FIG. 2. The locking pins 168 will be inserted into the various apertures 66, 70, 104, 108, 148, and 152 to connect the liners 40, 42, and 44 together. The overlapping relationship of the flanges 82, 84, 120, 122, 164, 166 will prevent the liners 40, 42, and 44 from falling out of the interior cylinder 20 as the liners 40, 42, and 44 become worn.

It is also likely that these liner segments, as defined herein, may further include vanes upon their outer surfaces, which when the liner segments are located in place, within a unit, will provide a gap between the liner segments and the inner surface of the cylinder 14, that would allow for conveyance of other materials, such as mold sand, to be shifted and transferred within the unit, when it is fabricated as a casting shakeout unit. These are just examples of the versatility of the formed liner segments, and how they may be assembled for use for a variety of machines, for application within the foundry and related industries. Obviously, if used within a casting shakeout, or sand or slag reclaiming unit, the liner segments may have perforations, so as to allow the mold sand, and other materials, to pass therethrough, and to be transferred by such segment integrated vanes.

Figure 6:
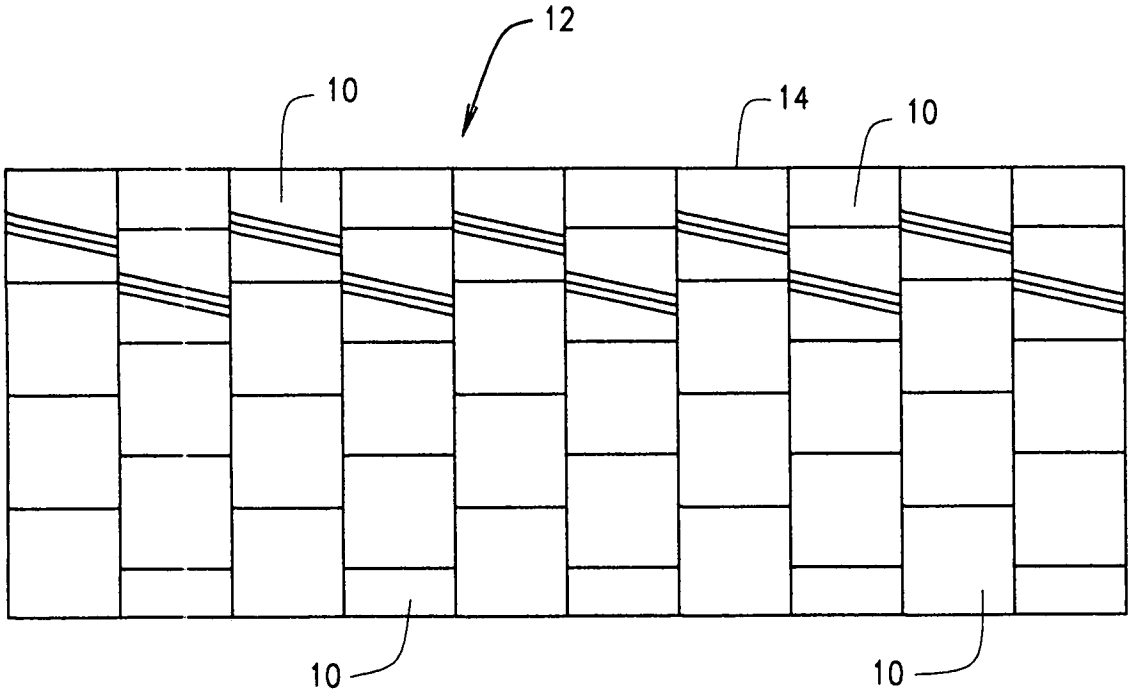
FIG. 6 is a longitudinal cross sectional view of the tumbling unit with all of its liner segments installed in place in preparation for usage.

FIG. 6 shows a longitudinal view of a tumbling unit, taken along a longitudinal section of the unit as shown in FIG. 1, disclosing how a plurality of such tumbling liner segments may be inter fitted together, to form the inner surface for the unit, such as previously shown and described in FIG. 1.

From all that has been said, it will be clear that there has thus been shown and described herein an interlocking liner for a tumbling unit, and the like. It will become apparent to those skilled in the art, however, that many changes, modifications, variations, and other uses and applications of the subject interlocking liner for a tumbling unit are possible and contemplated. All changes, modifications, variations, and other uses and applications which do not depart from the spirit and scope of the disclosure are deemed to be covered by the description, which is limited only by the claims which follow.

What is claimed is:

1. An interlocking liner segment for mating with adjacent liner segments for forming an interior cylinder of a tumbling unit, the interlocking liner segments being shaped and configured to mate with adjacent interlocking liner segments, the interlocking liner segment comprising:

a body having an inner arcuate surface having a first end and a second end, an outer surface, a first side edge, a second side edge, a front edge, and a back edge;

a first lifter portion at the first end of said liner segment having a first aperture, and said first lifter portion extending inwardly from said inner accurate surface and having a flat surface formed at said first end;

a second lifter portion at the second end of said liner segment having a second aperture, and said second lifter portion extending inwardly from said inner arcuate surface and having a flat surface formed at said second end of the liner segment;

a locking pin for insertion into the first aperture of said first lifter portion, and said locking pin capable of insertion into the rapture of an adjacent interlocking liner segment;

a second locking pin for insertion into the second aperture of said second lifter portion, and said second locking pin capable of insertion into the aperture of another adjacent interlocking liner segment locating at the second end of said interlocking liner segment; and a rifling portion on the inner arcuate surface of the liner segment and provided intermediate the first lifter portion and the second lifter portion of said interlocking liner segment.

2. The interlocking liner segment of claim 1, and further comprising a first side flange integrally formed upon said liner segment and extending out from the first side edge, a second side flange integrally formed upon said liner segment and extending out from said second side edge;

a series of formed pockets, there being a pocket formed in each of the first side edge and the second side edge of the liner segment, and each pocket being located adjacent the front edge and the back edge of said liner segment, and each pocket being adapted for receiving a portion of the respective first and second side flanges of adjacent interlocking liners.

3. The interlocking liner segment of claim 1, wherein said first lifter portion at the first end having a first pair of apertures, said second lifter portion of the second end having a second pair of apertures, a pair of pins for insertion into the pair of apertures in the first lifter portion, and another pair of pins for insertion into the pair of apertures in the second lifter portion.

4. The interlocking liner segment of claim 1, wherein the flat surfaces of adjacent liner segments mate together along a diameter of the formed tumbling unit.

5. The interlocking liner segment of claim 1 further comprising a shim having an aperture for alignment with the first aperture.

6. The interlocking liner segment of claim 1 and including a pair of interlocking liner segments, each liner segment having adjacent and mating lifter portions when said pair of liner segments are installed within a tumbling unit, each of said lifter segments having said apertures, said first and second apertures being aligned when a pair of the lifter segments from adjacent liner segments are located together, and said locking pins inserting in the first and second apertures of the adjacent liner segments to lock said liner segments together during installation.

7. The interlocking liner segments of claim 6, wherein each locking pin capable of pressure fitting within at least one of said first and second apertures.

* * * * *